United States Patent [19]

Barousse et al.

[11] Patent Number: 4,735,380

[45] Date of Patent: Apr. 5, 1988

[54] PRESSURIZED FLUID FEED SYSTEM

[75] Inventors: Michel Barousse, Montauban; Jean-Pierre Parissenti, L'Union; Roger Morvan, Gratentour, all of France

[73] Assignee: Aerospatiale Societe Nationale Industrielle, Paris, France

[21] Appl. No.: 13,036

[22] Filed: Feb. 10, 1987

[30] Foreign Application Priority Data

Feb. 26, 1986 [FR] France ..... 86 02635

[51] Int. Cl.[4] ..... B64F 1/00; G01M 17/00

[52] U.S. Cl. ..... 244/114 R; 60/429; 73/168; 137/165; 137/567; 137/572

[58] Field of Search ..... 60/405, 429, 386; 137/567, 572, 207.5, 207, 192, 165, 2, 11, 111; 244/58, 114 R; 91/32; 73/168

[56] References Cited

U.S. PATENT DOCUMENTS

| | | | |
|---|---|---|---|
| 1,779,319 | 10/1930 | Jennings | 137/165 X |
| 2,249,339 | 7/1941 | Wells et al. | 137/567 X |
| 2,364,709 | 12/1944 | Greer | 73/168 |
| 3,748,898 | 7/1973 | Hellouin de Menibus | 73/168 |
| 4,101,100 | 7/1978 | Smith et al. | 244/114 R |
| 4,116,577 | 9/1978 | Lauck | 60/405 X |

FOREIGN PATENT DOCUMENTS

| | | | |
|---|---|---|---|
| 669870 | 4/1952 | United Kingdom | 137/165 |

*Primary Examiner*—Martin P. Schwadron
*Assistant Examiner*—Stephen M. Hepperle
*Attorney, Agent, or Firm*—Fisher, Christen & Sabol

[57] ABSTRACT

A pressurized fluid feed system is provided intended to be temporarily connected to a fluid system formed of a pressurized fluid generator circuit and a fluid distributor circuit, this latter circuit including a tank and being intended to feed user devices an outlet of which is connected to an inlet of the tank, the temporary feed system being adapted to replace the fluid generating circuit.

11 Claims, 3 Drawing Sheets

PRESSURIZED FLUID FEED SYSTEM

BACKGROUND OF THE INVENTION

1. Field of the Invention

The present invention relates to a pressurized fluid feed system for temporary connection to a fluid system feeding user device.

2. Description of the Prior Art

As is known, such a fluid system is formed mainly of a fluid generating circuit and a fluid distributor circuit to which the user devices are connected.

In some applications, it is necessary to verify and check the operation of the devices using the fluid distributor circuit from another pressurized fluid feed system, the generating circuit not being able to be brought into service.

For example, in the aeronautic field, aircraft have a fluid system formed of a pressurized fluid generating circuit and a fluid distributor circuit feeding user devices, such, for example, as the flight commands, the landing gear, the braking members, etc . . .

In general, three identical fluid systems are provided in parallel in an obvious concern for safety.

The pressurized fluid generating circuit of one of the three systems includes, briefly, at least one hydraulic pump connected to an engine of the aircraft through which the rotor of the pump is driven in rotation, the pump thus transmits the fluid, coming from a feed pipe, at a given pressure to the distributor circuit comprising the devices.

An outlet pipe for the fluid coming from the user devices is connected, through a filter, to a tank itself connected, by means of a pipe, to the fluid generating circuit.

Thus, when the engines of the aircraft are operating, the user devices are able to be actuated by the pilot.

On the other hand, when the aircraft is being overhauled or assembled in hangars designed for these purposes, it is obvious that the engines cannot operate or be brought into service in these premises for safety reasons.

Consequently, the user devices cannot be controlled and tested by the pressurized fluid generating circuit of the fluid system of the aircraft.

Recourse is had at the present time to two methods for nevertheless being able to control and test the user devices mounted in the aircraft.

The first method consists, schematically, in feeding the distributor circuit of the aircraft directly from a ground feed system. It includes a hydraulic pump connected, upstream, to a hydraulic central unit and, downstream to a console for controlling and regulating the pressurized fluid. This console is connected to the distributor circuit of the aircraft and the return from the user devices passes directly through the filter of the circuit to a reservoir of the ground feed system, to which the pump is connected.

The tank of the aircraft, in this method, is not connected and is isolated from the ground feed system because of the overpressures to which it might be subjected and which might possibly cause it to blow out.

That involves appreciable disadvantages and high costs, since it is necessary to drain the return pipes, to make connections to the internal pipes of the fluid system of the aircraft, thus causing wear and deterioration of the connections.

In addition, during final filling of the fluid system of the aircraft, air risks getting in and causing harmful effects (emulsion, cavitation) in the ducts and pipes of the circuits.

The second method consists, schematically, in connecting each distributor circuit of the aircraft to a depot test bench in this case, each tank of the aircraft is connected to the whole of the circuit while being kept under constant pressure during the time required for testing and checking the user devices.

This method gets over some of the drawbacks of the first method but nevertheless raises difficulties related to the noise, to the congestion particularly of the working zones and to the cost of putting this method into practice. A depot test bench is necessary for each circuit or fluid system of each aircraft.

SUMMARY OF THE INVENTION

The aim of the present invention is to overcome the above mentioned drawbacks and relates to a pressurized fluid feed system temporarily taking the place of the pressurized fluid generating circuit and allowing, from a central ground hydraulic unit, the tank of the fluid distributor circuit to be used while continuously modulating the volume of fluid contained in said tank by injection of an auxiliary volume.

To this end, in accordance with the invention, the pressurized fluid feed system intended to be connected temporarily to a fluid system formed of a pressurized fluid generating circuit and a circuit for distributing said fluid, said distributor circuit including a tank and being intended to feed user devices an output of which is connected to an input of said tank, said temporary feed system being adapted for replacing said fluid generating circuit, is remarkable in that it is adapted for connection by means of a feed pipe to the input of said user devices and, by a return pipe, to an outlet of said tank and, in that it includes auxiliary fluid means, connected to said tank of said fluid distributor circuit, adapted for delivering a supplementary pressurized fluid into said tank, when the level of fluid contained in said tank reaches a predetermined threshold likely to be reached during activation of said user devices, and means for detecting said fluid level arranged on said tank for ensuring the actuation of said auxiliary fluid means.

In a preferred embodiment, the auxiliary fluid means include a pressure valve connected to a pressurized fluid source to a filter, a fluid pressure gauge associated with said valve and an electro-distributor disposed in a pipe connecting an outlet of said valve to said tank of the pressurized fluid distributor circuit.

According to another characteristic of the invention, said detection means are formed by a level detector connected to the electro-distributor of the auxiliary fluid means.

Advantageously, said level detector on the one hand, when the fluid level rises in said tank and reaches said threshold, causes said electro-distributor to switch into an open position corresponding to the injection of supplementary pressurized fluid into said tank and on the other, when the fluid level drops in said tank and recrosses said threshold, causes said electro-distributor to switch to a closed position corresponding to stopping of supplementary pressurized fluid injection into said tank.

So as to prevent feeding of the user devices with fluid should there be a pressure failure in the pressurized fluid source, an electric switch is advantageously situated in the pipe of said auxiliary fluid means. Similarly, said detection means include a high fluid level electric contactor contained in said tank preventing feeding of the user devices with fluid should the fluid level in the tank rise beyond a predetermined value.

In a preferred embodiment, the feed system includes a console for controlling and regulating the fluid connected to a hydraulic central unit, said console being connected further, by the pressurized fluid delivery or feed pipe, to the input of the user devices and, by the fluid return or suction pipe to the outlet of said tank. Preferably, the fluid from said pressurized source is a neutral gas.

BRIEF DESCRIPTION OF THE DRAWINGS

The Figures of the accompanying drawings will help in understanding how the invention may be put into practice. Identical references designate similar elements.

DESCRIPTION OF THE PREFERRED EMBODIMENT

Figure 1:
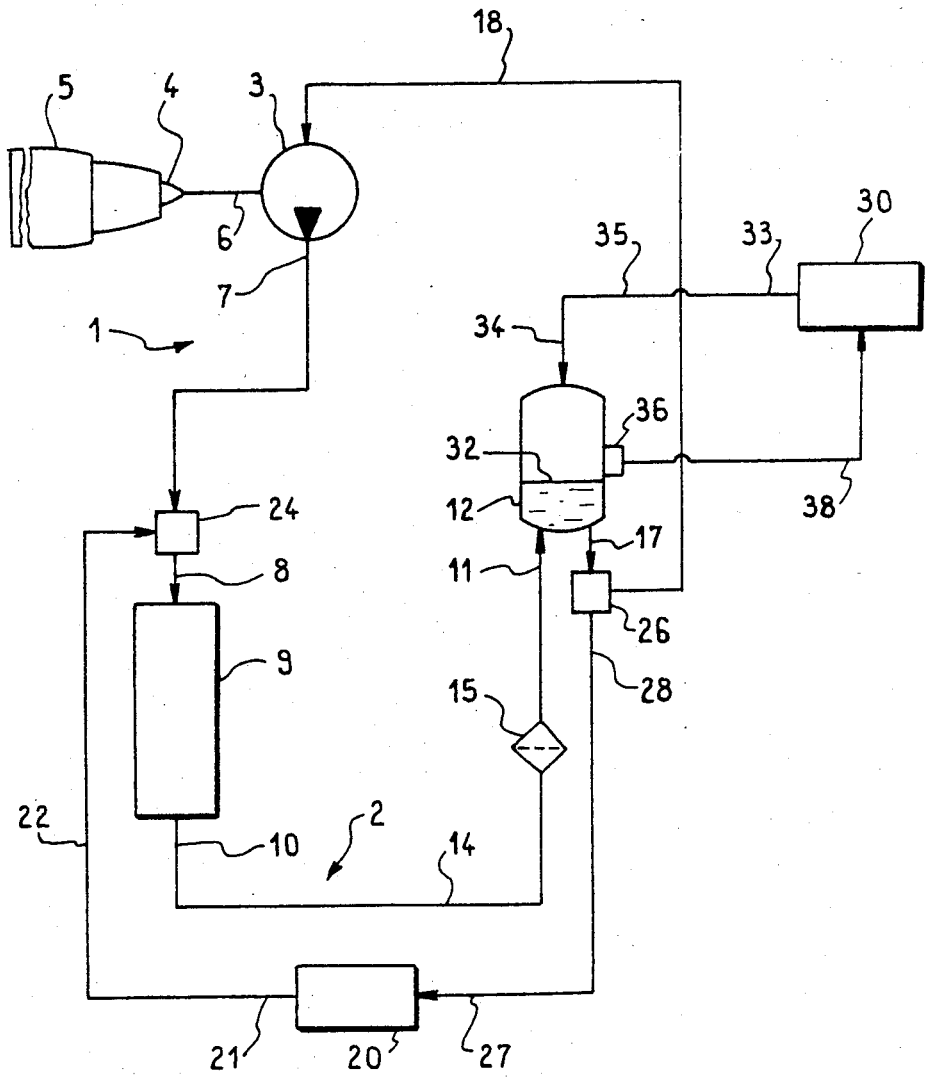
FIG. 1 is a functional diagram of a feed system according to the invention, associated with a fluid system for example of an aircraft.

The fluid system shown in FIG. 1 and intended for example for an aircraft, is formed of a first pressurized fluid generating circuit 1 and a second circuit 2 for distributing said fluid. For the sake of clarity, a single fluid system has been shown but aircraft in general have three fluid systems disposed in parallel.

The generating circuit 1 includes a hydraulic type pump 3 coupled to a turbine 4 of a motor 5 by means of a connection 6. Pump 3 thus delivers the pressurized hydraulic fluid through a fluid pipe 7 to an inlet 8 of the distributor circuit 2 formed by user devices 9 such for example as the flight controls and control surfaces, the landing gear, the braking members. The whole of these user devices 9, represented by a rectangle, is connected by an outlet 10 to an input 11 of a tank 12 through a pipe 14, in which is disposed a filter 15 for the fluid. Tank 12, which encloses a volume of hydraulic fluid, is connected by an outlet 17 to the pump 3 of the generating circuit 1 by means of a fluid pipe 18. Pump 3 thus sucks up fluid from the tank and delivers it under pressure to the user devices 9 of the distributor circuit 2 through the rotation of the rotor driven by the turbine.

The object of the invention is a feed system which can temporarily replace the pressurized fluid generating circuit 1 for the reasons recalled above in the preamble.

This feed system is formed schematically, in FIG. 1, by a pressurized fluid source 20, external to the fluid system of the aircraft and one outlet 21 of which is connected by a fluid pipe 22 to the input 8 of the distributor circuit through a valve 24 providing switching between passage of the fluid from the generating circuit 1 and passage of the fluid coming from the feed system and vice versa. Pipe 14 connecting the user devices 9 to the tank 11 is kept.

The outlet 17 of tank 12 includes a valve 26, which has the same function as the preceding one and thus allows the fluid from the tank to be switched to the generating circuit 1 or towards an input 27 of the pressurized fluid source 20 through a fluid pipe 28. This feed system thus replacing the generating circuit 1 includes, advantageously, auxiliary fluid means 30 adapted for delivering a supplementary pressurized fluid into tank 12, when the fluid level 32 contained in the tank reaches a predetermined threshold likely to be reached during actuation of the different user devices 9. These fluid means 30 avoid any over pressure in the tank, because of the appreciable volume of fluid returning from the user devices which would then risk blowing out and generating considerable troubles.

These means 30 are connected, by an outlet 33 to an inlet 34 of tank 12, through a duct or pipe 35 and are brought into action through means 36 detecting the level of the fluid 32, arranged on tank 12. In a simplified way, when the volume of fluid increases in tank 12 because of the actuation of several user devices 9 and when the level 32 reaches a predetermined threshold established by calculation, the detection means 36 deliver, through an electric connection 38, an electric signal which enables the feeding of supplementary pressurized fluid into the enclosure of tank 12, the fluid overflow being discharged through pipe 28 of the feed system.

Preferably, the supplementary pressurized fluid is a neutral gas.

The operation of the feed system will be described in greater detail with reference to FIGS. 2 and 3.

Figure 2:
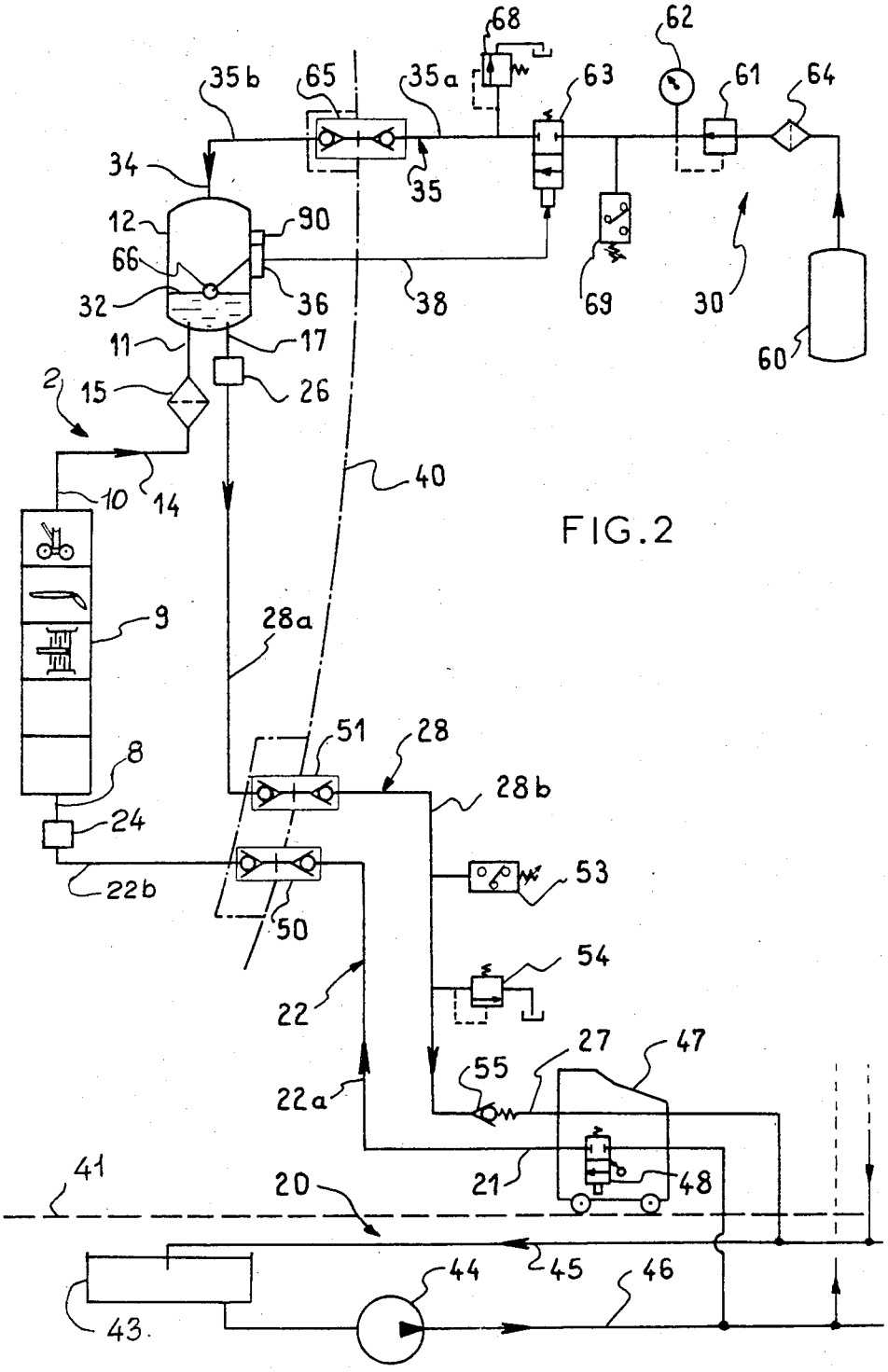
FIG. 2 shows a practical embodiment of a feed system associated with a fluid system.

FIG. 2 shows the fuselage 40 (with a dash dot line) of an aircraft standing on the ground 41 (shown with a broken line) of a hangar for assembling and/or maintaining these aircraft.

The generating circuit is no longer shown since it has been replaced by the pressurized fluid system of the invention and a central hydraulic unit 20 ensures the feed.

This central hydraulic unit 20 is formed of the assembly of a reservoir 43 and a hydraulic pump 44 connected by a pipe 46 to an electro-distributor 48 disposed in a console 47 for controlling and regulating the fluid; a pipe 45 ensures the return of the fluid to the reservoir 43.

From this console 47, which may for example be mobile, extends the fluid pipe 22 for feeding or delivering the pressurized fluid coming from pump 44. Pipe 22 connected to the outlet 21 of the electro-distributor 48 is connected to the inlet 8 of the user devices 9 of the distributor circuit 2 of the aircraft through valve 24.

In fact, pipe 22 is formed of two parts 22*a* and 22*b* connected together by means of a ground connection or self closing valve 50, provided in the fuselage 40 of the aircraft. This type of valve, shown schematically, prevents air from being introduced into the circuits during and/or disconnection of part 22*a* with part 22*b* and fluid from flowing into the working zones.

The part of the distributor circuit 2 of the aircraft connecting the user devices 9 to tank 12, through pipe 14, remains unchanged, which eliminates the risk of damage to the connections and the introduction of air into the internal pipes of the circuits of the aircraft.

The fluid return or suction pipe 28, connecting the outlet 17 of tank 12 through valve 26 to the inlet 27 of console 47 is formed, like pipe 22, of two parts 28*a* and 28*b* connected together by a self closing valve 51. In the part 28*b* of pipe 28 situated between a self closing valve 51 and console 47 are interposed a switch 53, a pressure limiter 54 and a calibrated non return valve 55.

The auxiliary fluid means 30 are formed of a fluid source 60, advantageously a neutral gas, a pressure valve 61 with which is associated a pressure gauge 62 connected to source 60 through a filter 64 and an electrodistributor 63 connected to the pressure gauge 62. The outlet pipe 35 is then connected to the inlet 34 of tank 12 of the distributor circuit 2 of the aircraft. Similarly as before, this pipe 35 is formed of two parts 35*a* and 35*b* connected together by an over-under pressure valve 65 arranged in the fuselage 40 of the aircraft. The detection means 36 situated on tank 12 are formed more particularly by a microcontact contactor controlled by a float 66 resting on the level 32 of the fluid contained in the tank.

This microcontact 36 is connected, by the above mentioned electric connection 38, to the electro-distributor 63.

Safety members have been interposed, in the part 35*a* of pipe 35 situated between valve 65 and the auxiliary fluid means 30, such as a pressure limiter 68 of the contactor 69.

The feed system operates in the following way: after connecting the different fluid delivery or feed pipes 22, the fluid return or suction pipes 28 and supplementary fluid means 30 to the distributor circuit 2 of the aircraft and after starting up the hydraulic pump 4, feeding from the central hydraulic unit 20 may take place.

The operator starts up the feed system, after checking and testing the different safety devices of the system, from the control and regulation console 47. The two position electro-distributor 48, placed in the console, switches and allows the pressurized fluid delivered by pump 44 into pipe 46 to flow through the fluid pipe 22, which then feeds the user devices 9. Some of these user devices, such as the landing gear, the flight controls and the braking members have been represented symbolically in FIG. 2.

The operator may then, from the piloting station of the aircraft, control the actuation of one or more of the user devices so as to be able to check and test operation thereof.

As these latter are actuated, generally several times, the pressurized fluid returns to the tank 12 in pipe 14 through the filter 15. The fluid level 32 rises in the tank, because of the considerable supply of fluid returning from the user devices 9. The float 66 of the microcontact level detector 36, resting on the fluid level 32, also rises until it reaches a position corresponding to a predetermined threshold equal to a given volume of fluid in tank 12. At that time, an electric signal delivered by the microcontact 36 is conveyed by the electric connection 38 to the electro-distributor 63 which switches and injects the neutral gas delivered by the supplementary fluid source 60 into tank 12 through pipe 35, this neutral gas having a pressure greater than the pressure of the fluid contained in the tank. Thus, the supplementary gas penetrating into the tank drives back the hydraulic fluid through the return pipe 28 and the float, continuing to rise to a certain height because of the above mentioned considerable supply of fluid, drops and crosses the threshold of the level detector 36 thus closing the microcontact, which results in breaking the electric connection 38 and causing the electro-distributor 63 to switch to the closed position.

The pressurized gas supply is then cut off. The hydraulic fluid flows and is discharged by the return and suction pipe 28, through the calibrated non return valve 55, which opens under the pressure which is greater than its initial calibration, as far as the assembly of reservoir 43 and pump 44 through pipe 45 connected to the console 47.

The level 32 of the fluid contained in the tank continues to drop until the time when the pressure therein reaches the calibrated value of the non return valve 55 which then closes off the fluid flow from pipe 28 towards pipe 45. This non return valve 55 maintains filling with hydraulic fluid of pipe 28 of the feed system and of pipe 14 and of the distributor circuit 2 of the aircraft.

The pressure limiter 54, arranged on the discharge pipe 28, and the pressure limiter 68, arranged on pipe 35, prevent the return under too high a pressure, on the one hand, of the hydraulic fluid towards reservoir 43 and, on the other hand, of the gas towards source 60.

Of course, when the fluid return from the user devices into the tank is not very high, the auxiliary fluid means do not come into action.

As soon as the tests and checks are finished, the feed system of the invention is uncoupled after placing valves 24 and 26 in communication with the generating circuit of the aircraft. The hydraulic system of this latter is then operational.

Figure 3:
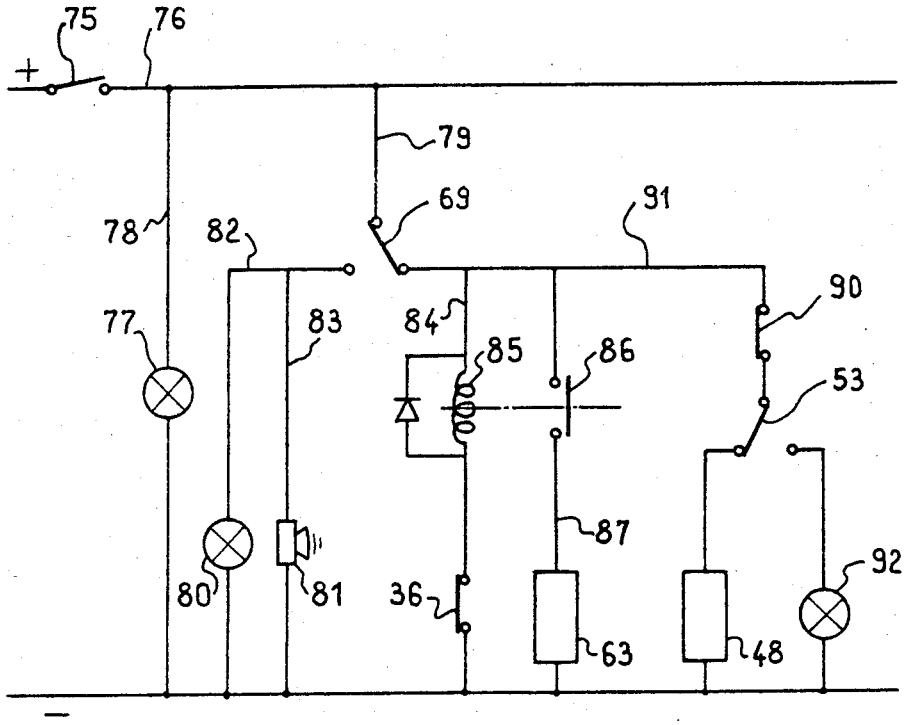
FIG. 3 shows the electric circuit associated with said feed system.

FIG. 3 shows the electric circuit of the feed system of the invention, including operating safety devices.

The circuit, fed by a low voltage source, includes an on-off switch 75 arranged on console 47 and whose output 76 is connected both to the ON indicator lamp 77 of the feed system through a connection 78 and to the switch 69 through a connection 79.

This switch is situated on the auxiliary fluid means between the electro-distributor 63 and the pressure gauge 62, associated with valve 61. The purpose of the switch is to prevent actuation of the feed system should there be a lack of pressure in the neutral gas fluid supply means, by acting on the electro-distributor 48 situated in console 47, which controls the hydraulic fluid supply of the system through pipe 22.

On the assumption that a lack of pressure has been discovered, the switch changes position and prevents operation of the system. The operator is then warned by a winking indicator lamp 80 and by an audiowarning system 81, disposed in parallel and connected to said switch respectively by a connection 82 and a connection 83.

In the case shown in FIG. 3, where no malfunction has been discovered, switch 69 occupies the position illustrated and is in relation, through an electric connection 84, with a relay 85 with which is associated the microcontact or contactor 36 disposed on tank 12.

Relay 85 is adapted for controlling a switch 86 connected to the electro-distributor 63 of the auxiliary fluid means 30 by an electric connection 87.

In the Figure, the microcontact 36 is in the closed position, which means that the level 32 of fluid contained in tank 12 is below the triggering threshold of the microcontact controlled by fluid 66. Consequently, the switch is open since it is pushed back by relay 85 and does not cause actuation of the electro-distributor 63.

On the other hand, in the case when the hydraulic fluid level reaches the predetermined threshold as was explained in the above described operation, the microcontact 36 opens and relay 85 no longer acts against a switch 86. This latter closes, causes the current coming from switch 69 to flow through connection 87 and the electro-distributor 63 to switch, which then allows pressurized neutral gas to be injected into tank 12 until the float again crosses said threshold so as to close the microcontact 36 and to open the switch 86 through the relay 85, cutting off the gas supply.

An additional safety device is aded to the electric circuit, for acting on the hydraulic fluid feed electro-distributor 48 of the distributor circuit 2 of the aircraft. In fact, in order to prevent the fluid volume level 32 from continuing to rise in the tank because of a malfunction of the auxiliary fluid means 30, the detection means 30 include a high level contactor 90 for the maximum fluid level tolerated in the tank.

This contactor 90 is connected to the output of switch 69 through a connection 91 and to the input of switch 53 disposed on the fluid return pipe 28.

Switch 53, shown in the operating position, is connected to the pressurized hydraulic fluid feed electro-distributor 48, preventing overpressure in the return circuit 28. This switch 53 switches then and immediately causes the electro-distributor 48 to change position, which cut off any supply of fluid towards the user devices 9. The pressurized fluid contained in the tank may then be discharged towards the reservoir 43 through the calibrated non return valve 55 of pipe 28. In addition, as soon as the electro-distributor changes position, switch 53 is connected to a winking lamp 92 which warns the operator that the pressure is too high. Opening of the high level contactor 19 immediately causes the electro-distributor 48 to change position, which cuts off any supply of fluid towards the user devices 9.

From the foregoing, the advantages of such a feed system in accordance with the invention with respect to those of the prior art, not only from the point of view of installation of the system properly speaking but also from the point of view of the safety means provided for correct operation of the system, are determinant and evident. It will be noted more particularly that, thanks to the present invention, it is possible to feed several hyraulic circuits of several aircraft from a single source (central hydraulic unit), the tanks of these aircraft being connected together.

What is claimed is:

1. In an on-board fluid system for aircraft comprising:

a hydraulic fluid pumping device coupled to a motor of said aircraft;

on-board user devices receiving hydraulic fluid from said hydraulic fluid pumping device through a connector feed pipe;

a tank for receiving said hydraulic fluid from said user devices through a receiving pipe and returning said hydraulic fluid to said pumping device through a return pipe, the improvement comprising:

a detachable ground hydraulic fluid feed system for said user devices;

a first switching device disposed on said connector feed pipe between said pumping device and said user devices, said first switching device being able to connect said user devices either to said pumping device, or to said detachable ground hydraulic fluid feed system;

a second switching device disposed on said return pipe between said tank and said pumping device, said second switching device being able to connect said tank either to said pumping device, or to said detachable ground hydraulic fluid feed system;

detecting means on said tank for detecting the level of hydraulic fluid in said tank;

a pressurized fluid source; and valve means disposed in a conduit means between said pressurized fluid source and said tank and controlled by said detecting means for introducing a pressurized fluid from said fluid source into said tank when said first and second switching devices connect said detachable ground hydraulic fluid feed system to said user devices and to said tank respectively and when the level of said hydraulic fluid reaches a predetermined threshold in said tank.

2. The improvement in an on-board fluid system for aircraft of claim 1, wherein said valve means is an electrodistributor.

3. The improvement in an on-board fluid system for aircraft of claim 2, wherein said detecting means, when the fluid level rises in said tank and reaches said threshold, causes said electro-distributor to switch to an open position to provide communication between said pressurized fluid and said tank and, when the fluid level drops in said tank below said threshold, causes said electro-distributor to switch to a closed position to close communication between said pressurized fluid source and said tank.

4. The improvement in an on-board fluid system for aircraft of claim 2, wherein the conduit means between said electro-distributor and said tank includes a self closing valve.

5. The improvement in an on-board fluid system for aircraft of claim 1, further comprising an electric switch for preventing feeding of the user devices should there be a lack of pressure from the pressurized fluid source.

6. The improvement in an on-board fluid system for aircraft of claim 1, wherein said detecting means include, an electric high level fluid contactor contained in said tank, preventing the user devices from being supplied with fluid should the level of the fluid in the tank rise beyond a predetermined valve.

7. The improvement in an on-board fluid system for aircraft of claim 4, wherein a pressure limiter is disposed between said electro-distributor and said self closing valve.

8. The improvement in an on-board fluid system for aircraft of claim 1, wherein the said pressurized hydraulic fluid source contains a neutral gas.

9. The improvement in an on-board fluid system for aircraft of claim 1, further comprising a fluid control and regulation console connected to said detachable ground hydraulic feed system, said console being further connectable through a pressurized fluid delivery pipe to the user devices and, through the fluid return pipe, to the outlet of said tank.

10. The improvement in an on-board fluid system for aircraft of claim 1, wherein self closing valves are disposed in said fluid delivery pipe and in said fluid return pipe.

11. The improvement in an on-board fluid system for aircraft of claim 1, wherein an electric switch, a pressure limiter switch and a calibrated non return valve are disposed in series between said tank and said ground detachable hydraulic fluid feed system to interrupt the flow of fluid between said tank and said pressurized fluid source.

* * * * *